US010072888B2

(12) United States Patent
Jeong et al.

(10) Patent No.: US 10,072,888 B2
(45) Date of Patent: Sep. 11, 2018

(54) REFRIGERATOR

(71) Applicant: SAMSUNG ELECTRONICS CO., LTD., Suwon-si, Gyeonggi-do (KR)

(72) Inventors: Jin Jeong, Yongin-si (KR); Bong Su Son, Cheonan-si (KR); Do Yun Jang, Busan (KR); Yeon Woo Cho, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 251 days.

(21) Appl. No.: 14/803,248

(22) Filed: Jul. 20, 2015

(65) Prior Publication Data

US 2016/0047591 A1 Feb. 18, 2016

(30) Foreign Application Priority Data

Aug. 18, 2014 (KR) ..... 10-2014-0107005

(51) Int. Cl.
*F25D 23/02* (2006.01)
*F25D 11/00* (2006.01)
(Continued)

(52) U.S. Cl.
CPC ..... *F25D 23/028* (2013.01); *F25C 1/04* (2013.01); *F25C 5/22* (2018.01); *F25D 11/00* (2013.01);
(Continued)

(58) Field of Classification Search
CPC ..... F25D 21/14; F25D 2323/0024; F25D 2323/121; F25C 5/22; F25C 5/18; F25C 5/128
See application file for complete search history.

(56) References Cited

U.S. PATENT DOCUMENTS 5,135,645 A * 8/1992 Sklenak ..... B01D 29/96 210/117
8,132,423 B2 * 3/2012 Tikhonov ..... F25D 17/045 62/340
(Continued)

FOREIGN PATENT DOCUMENTS

CN 102226620 10/2011
EP 1 621 831 A1 2/2006
(Continued)

OTHER PUBLICATIONS

Extended European Search Report dated Dec. 22, 2015 in European Patent Application 15180241.0.
(Continued)

*Primary Examiner* — Cassey D Bauer
(74) *Attorney, Agent, or Firm* — Staas & Halsey LLP

(57) ABSTRACT

Disclosed herein is a refrigerator having a body having a storage compartment; a door to open or close the storage compartment; a cover plate disposed at an inside the storage compartment; a cooling space formed in between the cover plate and an upper wall of the body; an evaporator provided at the cooling space to generate cool air; a blower fan provided at the cooling space to forcedly circulate the cool air generated at the evaporator; a cool air supplying hole formed at the cover plate to supply the cool air of the cooling space to the storage compartment; and a cool air collecting hole formed at the cover plate to collect the cool air heated at the storage compartment to the cooling space, and a rear wall of the storage compartment of the refrigerator may be evenly leveled and usefulness of space may be increased.

25 Claims, 8 Drawing Sheets

(51) Int. Cl.

| | |
|---|---|
| ***F25C 1/04*** | (2018.01) |
| ***F25D 21/00*** | (2006.01) |
| ***F25C 5/20*** | (2018.01) |

(52) U.S. Cl.

CPC ..... *F25D 21/00* (2013.01); *F25D 2317/061* (2013.01); *F25D 2321/1413* (2013.01); *F25D 2323/02* (2013.01); *F25D 2323/121* (2013.01)

(56) References Cited

U.S. PATENT DOCUMENTS

| | | | | |
|---|---|---|---|---|
| 9,097,458 | B2 * | 8/2015 | Buchstab | F25D 17/062 |
| 9,341,402 | B1 * | 5/2016 | Loudermilk | F25C 5/005 |
| 2004/0237565 | A1 * | 12/2004 | Lee | F25C 5/005 62/344 |
| 2006/0086129 | A1 | 4/2006 | Anselmino et al. | |
| 2009/0165486 | A1 * | 7/2009 | Harlen; Jochen | F25D 21/08 62/276 |
| 2010/0089089 | A1 | 4/2010 | Bischofberger et al. | |
| 2010/0126210 | A1 | 5/2010 | Rotter et al. | |
| 2012/0222435 | A1 | 9/2012 | Lopes et al. | |
| 2013/0098074 | A1 | 4/2013 | Hegedus et al. | |

FOREIGN PATENT DOCUMENTS

| | | |
|---|---|---|
| EP | 2 664 872 A2 | 11/2013 |
| JP | 50-9148 | 1/1975 |
| JP | 9-105576 | 4/1997 |

OTHER PUBLICATIONS

European Office Action dated Jun. 14, 2017 in corresponding European Patent Application No. 15 180 241.0.

European Office Action dated Jan. 23, 2018 in European Patent Application No. 15180241.0.

* cited by examiner

REFRIGERATOR

CROSS-REFERENCE TO RELATED APPLICATIONS

This application claims the benefit of the Korean Patent Application No. 10-2014-0107005, filed on Aug. 18, 2014, in the Korean Intellectual Property Office, the disclosure of which is incorporated herein by reference.

BACKGROUND

1. Field

Embodiments of the present disclosure relate to a refrigerator provided with an evaporator at a ceiling of a body thereof.

2. Description of the Related Art

In general, a refrigerator is a household appliance capable of storing foods in a fresh state while provided with a storage compartment at which the foods are stored and a cool air supplying apparatus to supply cool air at the storage compartment. The storage compartment is provided inside the body and is provided with a front surface thereof open. The open front surface of the storage compartment may be open or closed by a door.

The cool air supplying apparatus includes a cooling cycle having a compressor, a condenser, and an evaporator, and refrigerant circulated at the cooling cycle is provided to generate cool air at an outside while evaporating at the evaporator. The generated cool air is forced or circulated by a blower fan into the storage compartment.

The compressor at a conventional refrigerator is generally disposed at a machinery compartment provided at a lower portion of the body, and the evaporator is disposed at a rear of the storage compartment. In the conventional refrigerator, because the evaporator is disposed at the rear of the storage compartment, a rear wall of the storage compartment may not be evenly leveled, and the usefulness of the space of the storage compartment is low.

SUMMARY

Therefore, it is an aspect of the present disclosure to provide a refrigerator having with a rear wall of a storage compartment thereof evenly leveled and having an improved use of space by having an evaporator disposed at a ceiling or upper portion of the refrigerator.

It is another aspect of the present disclosure to provide a refrigerator having further improved use of space by having an evaporator to generate cool air as well as an ice maker to generate ice disposed at a ceiling or upper portion of the refrigerator.

It is still another aspect of the present disclosure to provide a refrigerator having further improved use of space as a water supplying system to supply water to a dispenser and to an ice maker is disposed at a ceiling of the refrigerator.

Additional aspects of the disclosure will be set forth in part in the description which follows and, in part, will be obvious from the description, or may be learned by practice of the disclosure.

In accordance with one aspect of the present disclosure, a refrigerator includes a body having a storage compartment; a door to open or close the storage compartment; a cover plate disposed at an inside the storage compartment; a cooling space formed in between the cover plate and an upper wall of the body; an evaporator provided at the cooling space to generate cool air; a blower fan provided at the cooling space to forcedly circulate the cool air generated at the evaporator; a cool air supplying hole formed at the cover plate to supply the cool air of the cooling space to the storage compartment; and a cool air collecting hole formed at the cover plate to collect the cool air heated at the storage compartment to the cooling space.

The cool air supplying hole may be provided at a front of the evaporator.

The cool air collecting hole may be provided at a rear of the evaporator.

The refrigerator may further include an ice maker provided at a front of the evaporator of the cooling space to generate ice.

The refrigerator may further include an ice bucket provided at the door to store the ice generated at the ice maker.

The refrigerator may further include an ice bucket cooling air supplying hole formed at the cover plate to supply the cool air of the cooling space to the ice bucket.

The ice bucket cooling air supplying hole may be provided at a front of the evaporator.

The refrigerator may further include a cool air collecting duct to communicate the cooling space to the ice bucket to collect the cool air heated at the ice bucket to the cooling space.

An entry of the cool air collecting duct may be provided at a front of the evaporator, and an exit of the cool air collecting duct may be provided at a rear of the evaporator.

The refrigerator may further include a defrosting heater provided at the surroundings of the evaporator of the cooling space to remove frost generated at the evaporator.

The refrigerator may further include a drain plate provided below the evaporator of the cooling space to collect the defrost water generated at the evaporator.

The drain plate may be downwardly inclined toward a rear wall of the body to guide the collected defrost water toward the rear wall of the body.

A refrigerant inlet pipe of the evaporator and a refrigerant outlet pipe of the evaporator each may be positioned at a front of the evaporator.

The refrigerator may further include a water supplying system provided at the cooling space to supply water to the ice maker or to supply water to a dispenser of the door.

The water supplying system may include a filter to filter the water supplied from an outside water supplying source.

The water supplying system may include a water tank to cool water by cool air of the cooling space.

The water supplying system may include a valve to divide the water supplied from the outside water supplying source to the water tank and the ice maker.

The filter may be mountably and detachably provided through the cover plate.

The cover plate may include a filter mounting hole configured to mount and dismount the filter therethrough, and a filter cover to open or close the filter mounting hole.

In accordance with another aspect of the present disclosure, a refrigerator includes a body having a storage compartment; a door to open or close the storage compartment; a cover plate disposed at an inside the storage compartment; a cooling space formed in between the cover plate and an upper wall of the body; an evaporator provided at the cooling space to generate cool air; a blower fan provided at the cooling space to forcedly circulate the cool air generated at the evaporator; an ice maker provided at the cooling space to generate ice; and a water supplying system provided at the cooling space to supply water to the ice maker or to supply water to a dispenser of the door.

A portion of the cool air of the cooling space is provided to cool the water supplying system of the cooling space while circulating at an inside the cooling space, and the remaining portion of the cool air of the cooling space is provided to be collected to the cooling space after cooling the storage compartment while supplied to the storage compartment.

The refrigerator may further include an ice bucket provided at the door to store the ice generated at the ice maker.

A portion of the cool air of the cooling space is provided to cool the water supplying system of the cooling space while circulating at an inside the cooling space, another portion of the cool air of the cooling space is provided to be collected to the cooling space after cooling the storage compartment while supplied to the storage compartment, and the remaining portion of the cool air of the cooling space is provided to be collected to the cooling space after cooling the ice bucket while supplied to the ice bucket.

In accordance with still another aspect of the present disclosure, a refrigerator includes a body having a storage compartment; a door to open or close the storage compartment; a cover plate disposed at an inside the storage compartment; a cooling space formed in between the cover plate and an upper wall of the body; an evaporator provided at the cooling space to generate cool air; a blower fan provided at the cooling space to forcedly circulate the cool air generated at the evaporator; an ice maker provided at the cooling space to generate ice; and an ice-bucket provided at the door to store the ice generated at the ice maker.

A portion of the cool air of the cooling space may be collected to the cooling space after cooling the storage compartment while supplied to the storage compartment, and the remaining portion of the cool air of the cooling space is provided to be collected to the cooling space after cooling the ice bucket while supplied to the ice bucket.

The refrigerator may further include a water supplying system provided at the cooling space to supply water to the ice maker or to supply water to the dispenser of the door.

A portion of the cool air of the cooling space is provided to cool the water supplying system of the cooling space while circulating at an inside the cooling space, another portion of the cool air of the cooling space is provided to be collected to the cooling space after cooling the storage compartment while supplied to the storage compartment, and the remaining portion of the cool air of the cooling space is provided to be collected to the cooling space after cooling the ice bucket while supplied to the ice bucket.

In accordance with another aspect of the present disclosure, a refrigerator includes a body having a first storage compartment and a second storage compartment, a cover plate disposed at an inside of the first storage compartment, a first cooling space formed in between the cover plate and a top of the first storage compartment, a first evaporator provided within the first cooling space to cool the first storage compartment, a cover disposed at an inside of the second storage compartment, a second cooling space formed in between the cover and a wall of the second storage compartment, and a second evaporator provided within the second cooling space to cool the second storage compartment.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
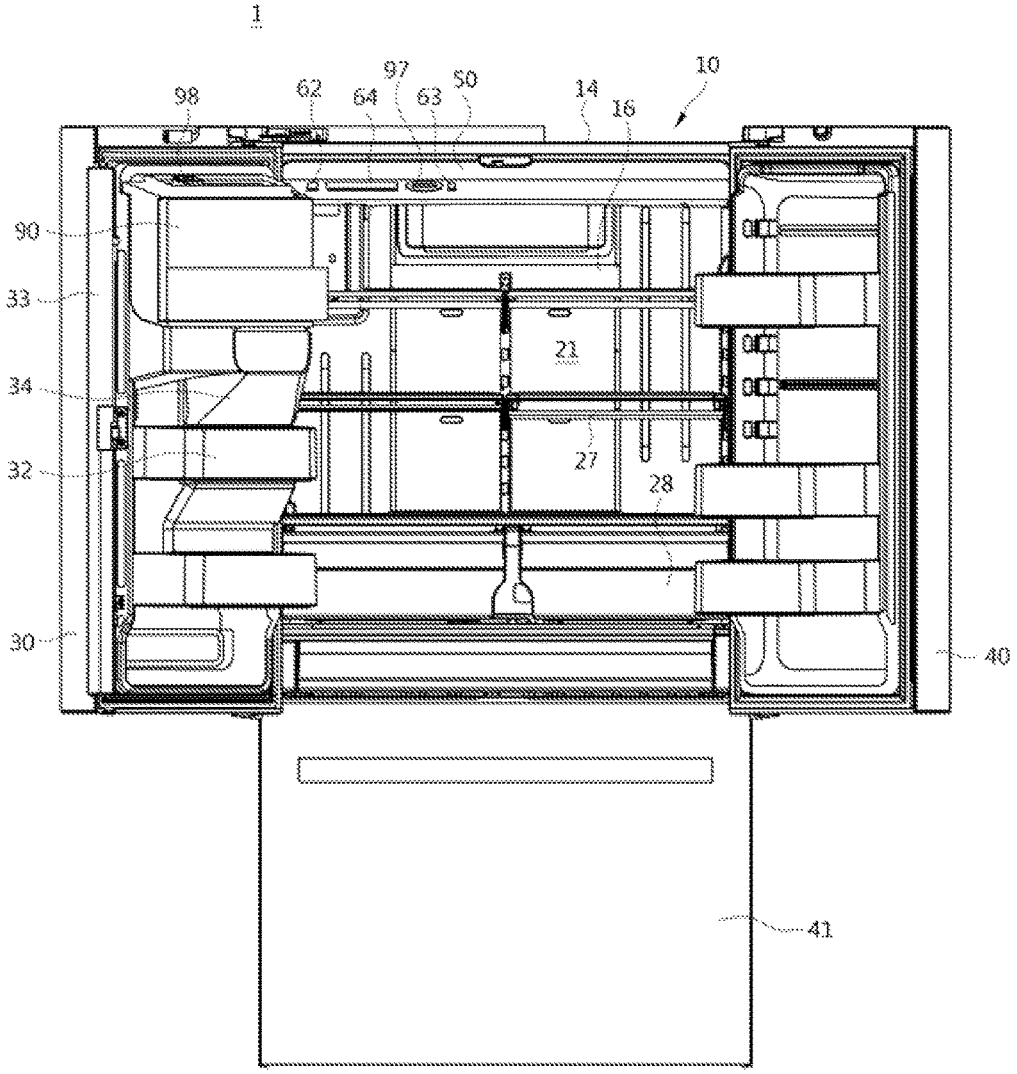
FIG. 1 is a drawing illustrating an external appearance of a refrigerator in accordance with one embodiment of the present disclosure.

Reference will now be made in detail to the embodiments of the present disclosure, examples of which are illustrated in the accompanying drawings, wherein like reference numerals refer to like elements throughout.

Figure 2:
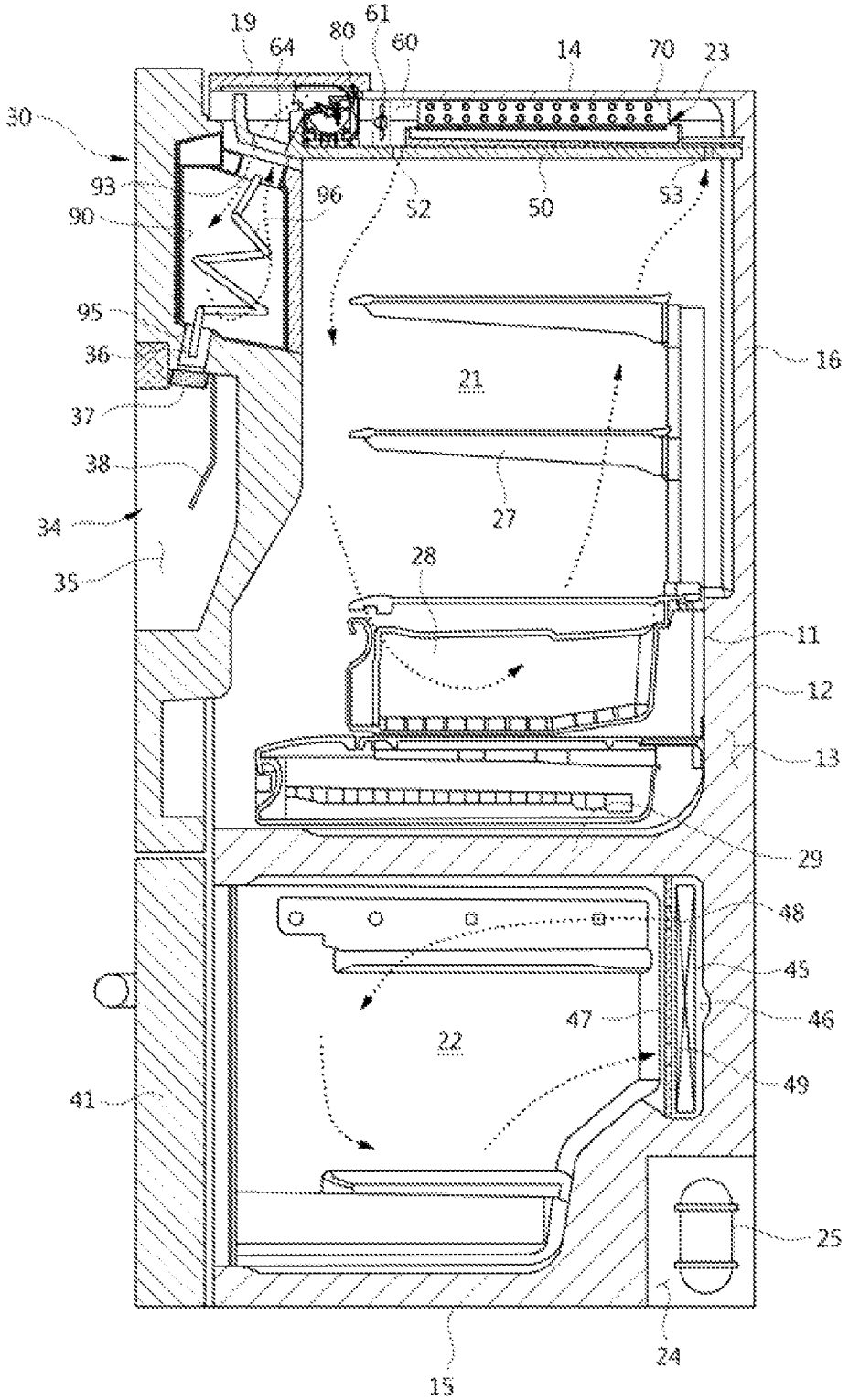
FIG. 2 is a schematic side cross-sectional view of the refrigerator of FIG. 1.
Figure 3:
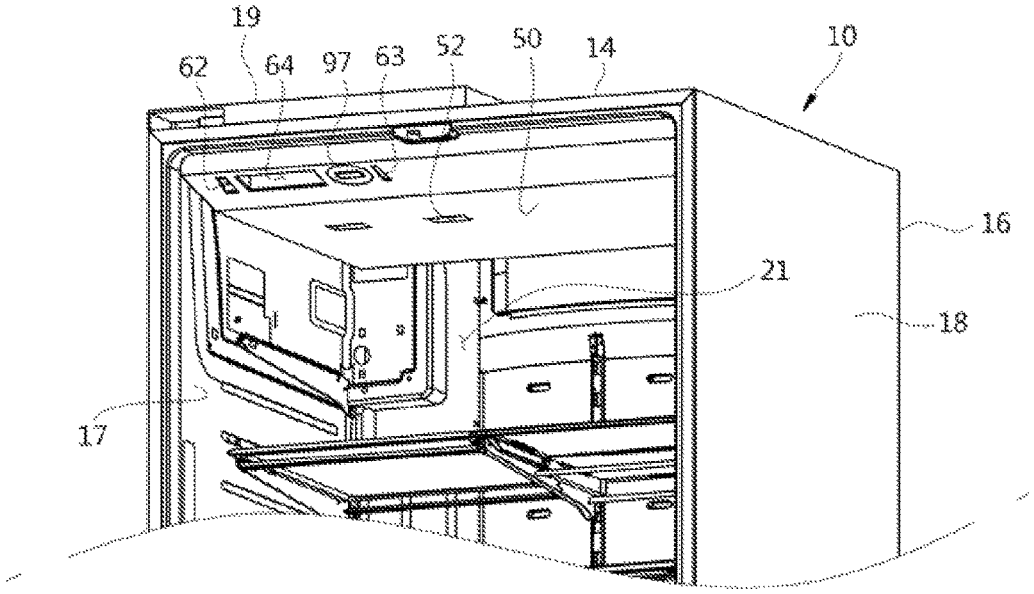
FIG. 3 is a lower perspective view illustrating an enlarged view of a ceiling of the refrigerator of FIG. 1.
Figure 4:
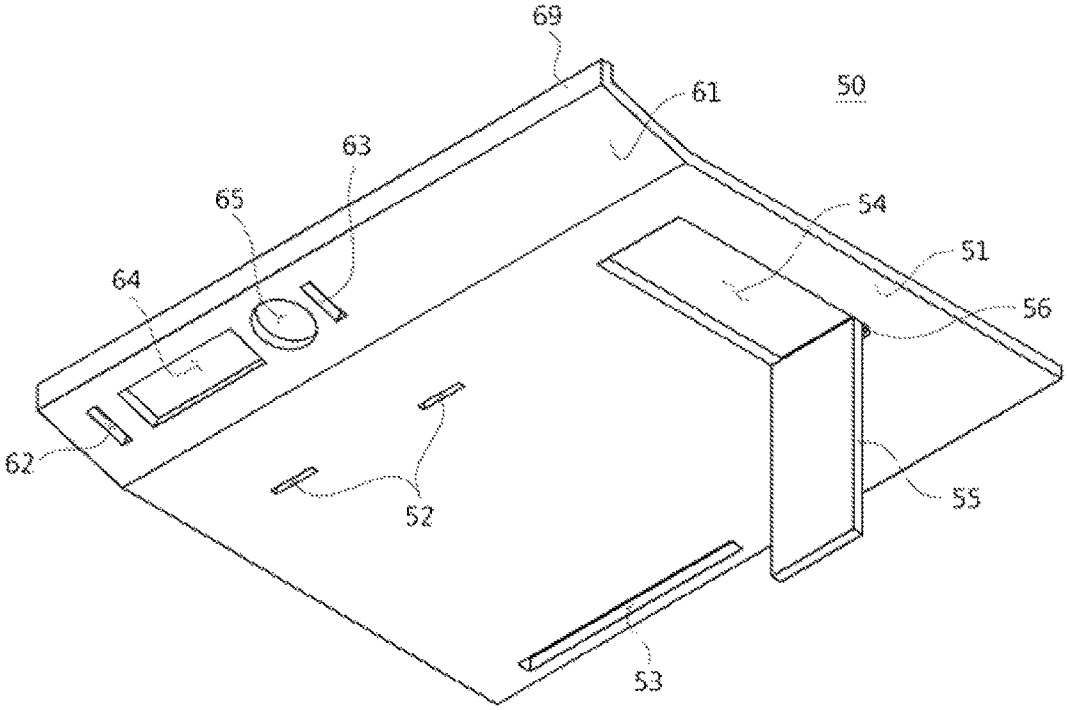
FIG. 4 is a lower perspective view illustrating a cover plate disposed at an inside a storage compartment of the refrigerator of FIG. 1.
Figure 5:
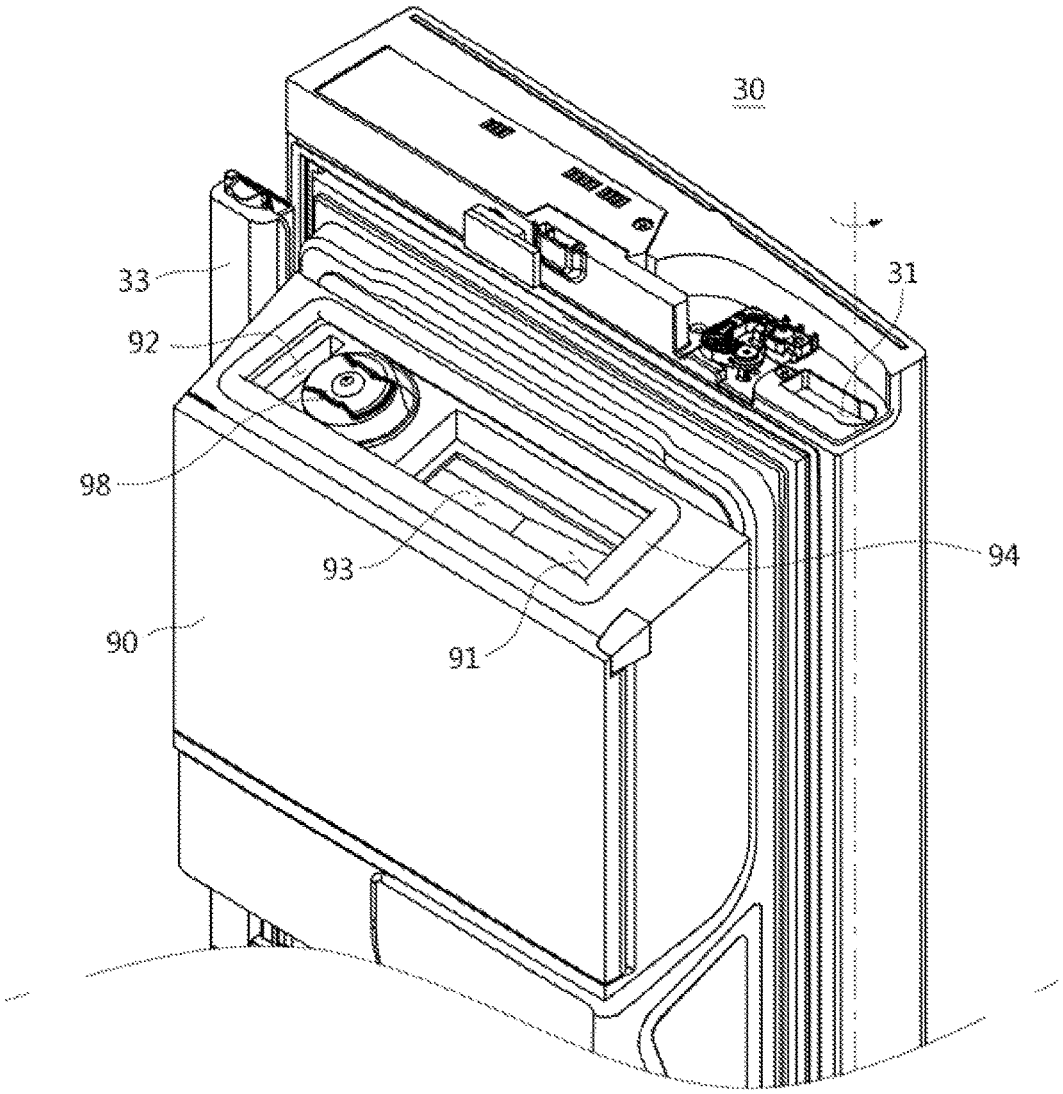
FIG. 5 is a drawing illustrating an ice bucket of a door of the refrigerator of FIG. 1.

FIG. 1 is a drawing illustrating an external appearance of a refrigerator in accordance with one embodiment of the present disclosure, FIG. 2 is a schematic side cross-sectional view of the refrigerator of FIG. 1, FIG. 3 is a lower perspective view illustrating an enlarged view of a ceiling of the refrigerator of FIG. 1, FIG. 4 is a lower perspective view illustrating a cover plate disposed at an inside a storage compartment of the refrigerator of FIG. 1, and FIG. 5 is a drawing illustrating an ice bucket of a door of the refrigerator of FIG. 1.

Referring to FIG. 1 to FIG. 5, a refrigerator 1 in accordance with one embodiment of the present disclosure includes a body 10, storage compartments 21 and 22 formed at an inside of the body 10, a cool air supplying apparatus 23 to generate cool air, and doors 30, 40, and 41 to open or close the storage compartments 21 and 22.

The body 10 is provided with the approximate shape of a box, and may include an inner case 11 and an outer case 12. The inner case 11 is formed by use of a resin material, and may form the storage compartments 21 and 22 at an inside thereof. A foamed insulation material 13 configured to insulate the storage compartments 21 and 22 may be filled in between the inner case 11 and the outer case 12.

From a different perspective, the body 10 may include a ceiling 14 or an upper wall 14, a bottom 15, a rear wall 16, a left side wall 17, and a right side wall 18.

The storage compartments 21 and 22 may be divided into an upper storage compartment 21 and a lower storage compartment 22 by a middle partition wall 29. The upper storage compartment 21 may be used as a refrigerating compartment, and the lower storage compartment 22 may be used as a freezing compartment, and alternatively, the upper storage compartment 21 may be used as a freezing compartment, and the lower compartment 22 may be used as a refrigerating compartment. That is, the refrigerator may be in the form of a BMF (Bottom Mounted Freezer) type or a TMF (Top Mounted Freezer) type.

However, differently from the present embodiment, the storage compartments of a refrigerator may be divided into left and right sides by a vertical partition wall. That is, the refrigerator may be in the form of a SBS (Side By Side) type. Or, a refrigerator may be provided with one storage compartment without a separate partition wall. Even in the form of the refrigerator as such, the aspects of the present disclosure may be applied.

Each of the storage compartments 21 and 22 may be provided with a front surface thereof open to deposit or withdraw foods. The open front surfaces may be open or closed by the doors 30, 40, and 41. The upper storage compartment 21 may be open or closed by the plurality of rotating doors 30 and 40. The lower storage compartment 22 may be open or closed by the drawer-type door 41 configured to be inserted into or withdrawn from an inside.

A shelf 27 capable of supporting foods and a sealed container 28 to store foods in a sealed state may be provided at the storage compartment 21.

A door guard 32 in which foods may be stored may be provided at a lower surface of the door 30. An ice bucket 90 to store the ice generated at an ice maker 80 may be provided at the door 30. A rotating axis hole 31 into which a hinge axis (not shown) is coupled so that the door 30 may be rotated, and a filler member 33 to prevent the cool air of the storage compartment 21 from being released by sealing the in between of the door 30 and the door 40 in a state of the doors 30 and 40 being closed, may be provided at the door 30.

A dispenser 34 at which a user may be supplied with water or ice without having to open the doors 30 and 40 may be provided at the door 30. The dispenser 34 may include a dispensing space 35 concavely formed at a front surface of the door 30 so that a user may be supplied with water or ice by inserting a container such as a cup thereinto, a chute 36 connecting an outlet 95 of the ice bucket 90 to the dispensing space 35 of the dispenser 34, an opening/closing member 37 to open or close the chute 36, and a dispensing switch 38 to drive the opening/closing member 37.

When the opening/closing member 37 is open or closed by driving the dispensing switch 38, the ice stored in the ice bucket 90 is dropped into the dispensing space 35 through the chute 36, so that a user may be supplied with ice without opening the doors 30 and 40.

The cool air supplying apparatus 23 is configured to form cool air by circulating a cooling cycle, and may supply the generated cool air to the storage compartments 21 and 22. The cool air supplying apparatus 23 may include a cooling cycle apparatus having a compressor 25, a condenser (not shown), an expansion apparatus (not shown), and evaporators 45 and 70, a refrigerant pipe 26 to guide refrigerant to the each cooling cycle apparatus, and a blower fan 61 to forcedly circulate air to supply the cool air generated at the evaporators 45 and 70 to the storage compartments 21 and 22. The compressor 25 may be disposed at a machinery compartment 24 formed at a lower portion of the body 10.

The cool air supplying apparatus 23 may include the plurality of evaporators 45 and 70 to independently cool the upper storage compartment 21 and the lower storage compartment 22. In the present embodiment, the upper evaporator 70 may cool the upper storage compartment 21, and the lower evaporator 45 may cool the lower storage compartment 22. However, differently from the present embodiment, the upper storage compartment 21 and the lower storage compartment 22 may be simultaneously cooled by use of a single evaporator.

The lower evaporator 45 may be disposed at or within a lower cooling space 47 separately divided by a cover 46. The cool air generated at the lower evaporator 45 may be supplied to the lower storage compartment 22 through a supplying hole 48 formed at the cover 46, and after circulating in the lower storage compartment 22, through a collecting hole 49 formed at the cover 46, the cool air may be collected to the lower cooling space 47. A blower fan (not shown) to forcedly direct or circulate cool air may be provided at the supplying hole 48 or the collecting hole 49.

The upper evaporator 70 may be disposed at a cooling space 60 formed in between a cover plate 50 disposed at an inside of the upper storage compartment 21 and the upper wall 14 or ceiling 14 of the body 10. The cooling space 60 may be reciprocally divided by the cover plate 50 from a remaining domain of the storage compartment 21 while excluding the cooling space 60. As the evaporator 70 is disposed at an inside of the cooling space 60, the inside of the cooling space 60 may be directly cooled by the cool air generated at the evaporator 70 without requiring a separate duct structure.

The cover plate 50 is provided to divide the cooling space 60, and the remaining domain of the storage compartment 21 while excluding the cooling space 60, and to cover the components disposed at the cooling space 60. The cover plate 50 may be provided in the shape of a plate. The cover plate 50 may be provided in the shape of a bent plate.

Referring to FIG. 4, the cover plate 50 may include a body unit 51, a front inclination unit 61 inclinedly formed at a front of the body unit 51, and a front surface unit 69 configured to prevent the cooling space 60 from being exposed to a front while inclinedly formed at the front of the front inclination unit 61.

In the present embodiment, the body unit 51 is formed to be in an approximately horizontal manner, but is not limited hereto, and the body unit 51 as well may be inclinedly formed.

The body unit 51 may be provided with a cooling air supplying hole 52 formed therein to supply the cool air of the cooling space 60 to the storage compartment 21, a cool air collecting hole 53 formed therein to collect the cool air heated at the storage compartment 21 to the cooling space 60, and a filter mounting hole 54 formed therein to mount and dismount a filter 101. In addition, the body unit 51 may be provided with a filter cover 55 to open or close the filter mounting hole 54. The filter cover 55 may be rotatably provided while having a hinge axis 56.

The cooling air supplying hole 52 and the cool air collecting hole 53 each may be provided with at least one unit thereof. The cooling air supplying hole 52 may be provided at a front of the evaporator 70, and the cool air collecting hole 53 may be provided at a rear of the evaporator 70. So, as illustrated in FIG. 2, the air introduced into the cooling space 60 from the storage compartment 21 through the cool air collecting hole 53 is heat-exchanged and cooled at the evaporator 70, and may be stored at the storage compartment 21 through the cooling air supplying hole 52 at the front of the evaporator 70.

The front inclination unit 61 may be provided with an ice passing unit 64 formed thereto as the ice of the ice maker 80 is descended to the ice bucket 90 through the ice passing unit 64, an ice bucket cool air supplying hole 62 formed thereto to supply the cool air of the cooling space 60 to the ice bucket 90, an ice bucket cool air collecting hole 63 formed thereto to collect the cool air heated at the ice bucket 90 to the cooling space 60, and a coupler coupling hole 65 formed thereto as coupler apparatuses 97 and 98 are coupled to the coupler coupling hole 65 to deliver a driving force at a stirrer 96 of the ice bucket 90.

The cover plate 50 as such may finally be coupled to an upper portion of an inner side of the storage compartment 21 after the components such as the evaporator 70 and the blower fan 61 are coupled to the upper wall 14 of the body 10. The components such as the evaporator 70 and the blower fan 61 may be coupled to the upper wall 14 of the body 10 of the refrigerator 1 through one of various coupling structures such as a hooking structure, an inserting structure, and a screw-fastening structure. The cover plate 50 as well may be coupled to the upper wall 14 of the body 10 of the refrigerator 1 through one of the various coupling structures such as the hooking structure, the inserting structure, and the screw-fastening structure.

However, differently from the above, the cover plate 50 may be coupled to an upper portion of an inner side of the storage compartment 21 after the components such as the evaporator 70 and the blower fan 61 are assembled at an upper surface of the cover plate 50.

The height of the cooling space 60, that is, the height in between the cover plate 50 and the upper wall 14 of the body 10, is not large, and thus the evaporator 70 may be disposed at the cooling space 60 while in a laid status.

Figure 6:
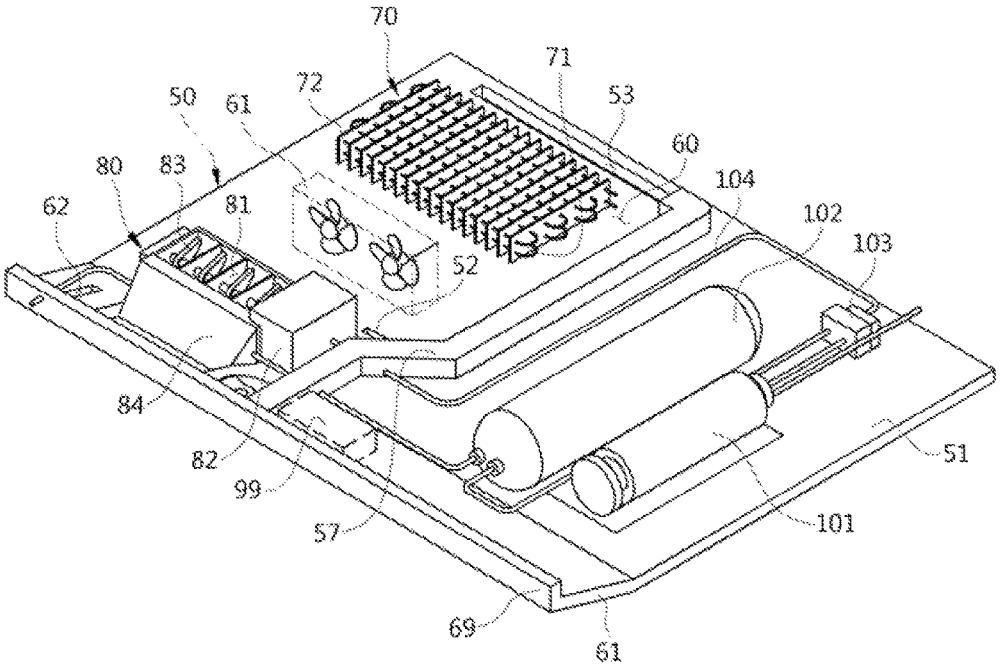
FIG. 6, as a perspective view illustrating an inside of a cooling space provided at a ceiling of the refrigerator of FIG. 1, is the perspective view illustrating the refrigerator after removing an upper wall.
Figure 7:
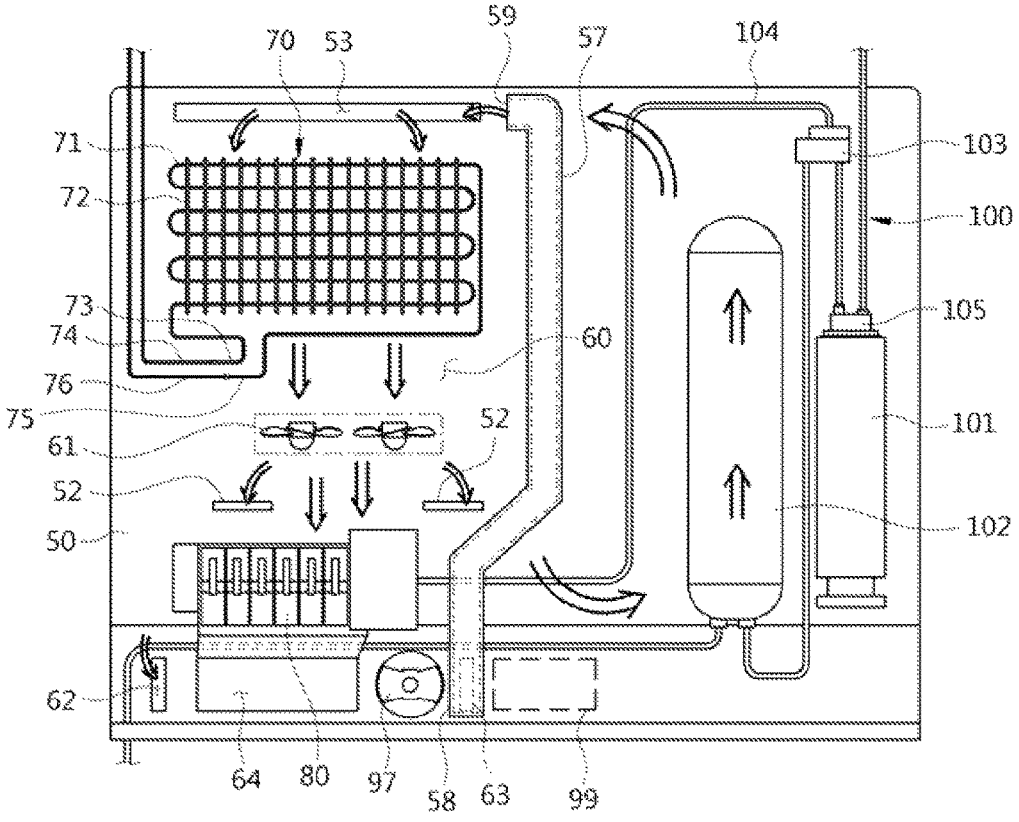
FIG. 7 is a plane view illustrating an inside the cooling space provided at the ceiling of the refrigerator of FIG. 1.
Figure 8:
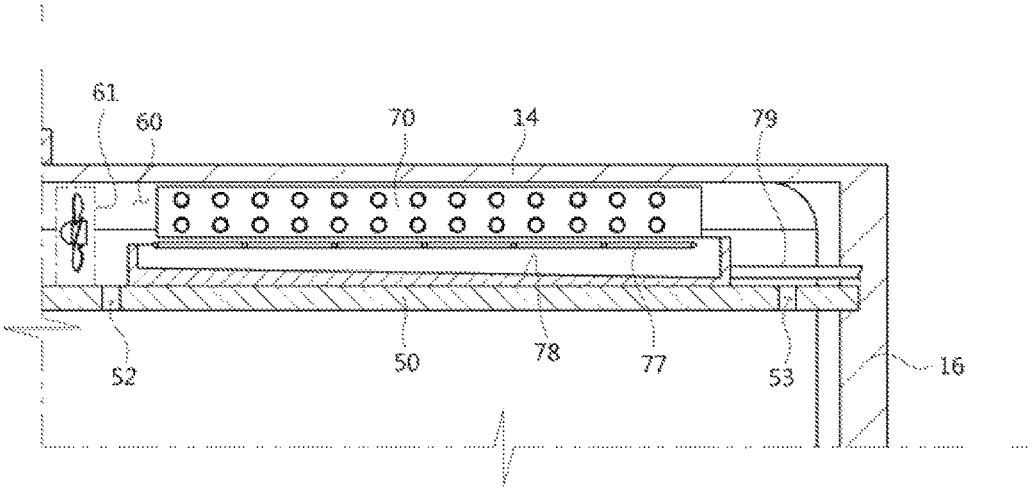
FIG. 8 is a cross-sectional view illustrating an enlarged view of an evaporator of the refrigerator of FIG. 1.

FIG. 6, as a perspective view illustrating an inside the cooling space provided at a ceiling of the refrigerator of FIG. 1, is the perspective view illustrating the refrigerator after removing an upper wall, FIG. 7 is a plane view illustrating an inside the cooling space provided at the ceiling of the refrigerator of FIG. 1, and FIG. 8 is a cross-sectional view illustrating an enlarged view of the evaporator of the refrigerator of FIG. 1.

Referring to FIG. 6 to FIG. 8, the evaporator 70 may be a pin-tube type heat-exchanging apparatus having a heat-exchanging tube 71 to heat-exchange with the surrounding air while a refrigerant is provided to flow, and a heat-exchanging pin 72 to expand a heat-transferring area while making contact with the heat-exchanging tube 71. The each heat-exchanging pin 72 may be disposed in forward/backward directions with respect to each other not to interrupt the flow of air. The heat-exchanging tube 71 may be provided to penetrate the heat-exchanging pin 72. The heat-exchanging tube 71 may be provided with the shape of a zigzag pattern.

The evaporator 70 may be provided with a refrigerant inlet pipe 73 such that a refrigerant is inlet into the heat-exchanging tube 71 through the refrigerant inlet pipe 73, and a refrigerant outlet pipe 75 such that the refrigerant of the heat-exchanging tube 71 is discharged through the refrigerant outlet pipe 75. The refrigerant pipe 26 may be connected to the each of the refrigerant inlet pipe 73 and the refrigerant outlet pipe 75. The refrigerant pipe 26 is penetrated through the rear wall 16 of the body 10, and may be extended to the cooling space 60 along the side wall 17 of the body 10.

The refrigerant inlet pipe 73 of the evaporator 70, as well as the refrigerant outlet pipe 75, may be positioned at a front of the evaporator 70. Therefore, the connecting task of the refrigerant inlet pipe 73 and the refrigerant outlet pipe 75, as well as the connecting task of the refrigerant outlet pipe 75 and the refrigerant pipe 26, may be taken place at a front of the evaporator 70. That is, a connecting unit 74 of the refrigerant pipe 26 and the refrigerant inlet pipe 73, as well as a connecting unit 76 of the refrigerant pipe 26 and the refrigerant outlet pipe 75, may be positioned at a front of the evaporator 70. By the structure as such, a convenience of an assembly may be improved.

A defrosting heater 77 configured to radiate heat to remove frost, which is formed at a surface of the evaporator 70 due to the difference of temperature, may be provided at the surroundings of the evaporator 70. The defrosting heater 77 may be provided in the form of a code heater. The defrosting heater 77 may be disposed below the evaporator 70 in the shape of a zigzag pattern to correspond to the area of the evaporator 70.

A drain plate 78 configured to gather defrost water, which is formed as frost is melted, may be provided below the evaporator 70. The drain plate 78 may be downwardly inclined toward the rear wall 16 of the body 10 to guide the gathered defrost water toward the rear wall 16 of the body 10. The drain plate 78 may be connected to a hose 79 configured to guide the gathered defrost water to the machinery compartment 24 or to an outside the body 10. The drain hose 79 may be provided to penetrate the rear wall 16 of the body 10.

The blower fan 61 configured to increase heat-exchanging efficiency of the evaporator 70 by forcedly flowing air and to circulate cool air may be provided at the cooling space 60. The blower fan 61 may be provided at a front of the evaporator 70. Therefore, the blower fan 61 is provided to inlet air from a rear of the evaporator 70, heat-exchange the inlet air by having the inlet air pass through the evaporator 70, and forcedly flow the air cooled through the evaporator 70 toward a front of the evaporator 70.

The refrigerator 1 may further include an ice maker 80 to generate ice. The ice maker 80 may include an ice-making cell 81 configured to accommodate water and generate ice while provided with the approximate shape of a semicircle, a scraper 83 rotatably provided to move the ice generated at the ice-making cell 81 from the ice-making cell 81, a driving unit 82 having a motor configured to provide a driving force to rotate the scraper 83, and a slider 84 inclinedly formed to descend the ice moved from the ice-making cell 83 to the ice bucket 90 provided at the door 30.

In the present embodiment, the ice maker 80 may be provided at a front of the evaporator 70. Therefore, the cool air generated at the evaporator 70 is provided to flow toward the ice maker 80 by the blower fan 61, and ice may be generated at the ice maker 80 by the cool air as such. However, differently from the present embodiment, the ice maker 80 may be provided in the form of a direct-cooling type ice maker configured to be delivered with cooling energy as a direct contact is made with the refrigerant pipe 26.

In a case when the height of the ice maker 80 is large enough not to be completely accommodated at the cooling space 60, the upper wall 14 of the body 10 may be partially provided with an open portion thereof to accommodate the ice maker 80. An upper cover 19 (FIG. 2) may be coupled to the open portion, or the upper wall 14 of the body 10 may be provided to be protruded in some degree toward an upper side.

As described above, the ice passing unit 64 may be formed at the cover plate 50 so that the ice moved from the ice maker 80 may be descended to the ice bucket 90 provided at the door 30. An ice inlet unit 93 may be formed at an upper end of the ice bucket 90 at a position corresponding to the ice passing unit 64 of the cover plate 50.

In addition, the ice bucket cool air supplying hole 62 is formed at the cover plate 50 to cool the ice stored at the ice bucket 90 by supplying the cool air of the cooling space 60 at the ice bucket 90, and a cool air inlet 91 may be formed at the ice bucket 90 at a position corresponding to the ice bucket cool air supplying hole 62.

That is, the cool air of the cooling space 60 may be supplied to an inside the ice bucket 90 through the ice bucket cool air supplying hole 62 of the cover plate 50 and the cool air inlet 91 of the ice bucket 90. The ice bucket cool air supplying hole 62 may be formed at a front of the evaporator 70.

A cool air collecting duct 57 may be provided at the cover plate 50 to collect the cool air heated at the ice bucket 90 to the cooling space 60. The cool air collecting duct 57 may be integrally formed with the cover plate 50 at an upper surface of the cover plate 50. Therefore, the cool air collecting duct 57 need not take over the space of the storage compartment 21 without being exposed at the storage compartment 21. However, differently from the present embodiment, the cool air collecting duct 57 may be provided separately from the cover plate 50, or may be provided at a lower surface of the cover plate 50.

An entry 58 of the cool air collecting duct 57 may be provided at a front of the evaporator 70, and an exit 59 of the cool air collecting duct 57 may be provided at a rear of the evaporator 70. A cool air outlet 92 may be provided at the ice bucket 90 at a position corresponding to the entry 58 of the cool air collecting duct 57.

Therefore, the cool air heated at the ice bucket 90 may be collected to the cooling space 60 after passing through the cool air outlet 92 of the ice bucket 90, as well as through the cool air collecting duct 57 of the cover plate 50.

In the present embodiment, the cool air inlet 91 of the ice bucket 90 is integrally formed with the ice inlet unit 93 of the ice bucket 90, but is not limited hereto, and the cool air inlet 92 and the ice inlet unit 93 may be separately formed.

The ice bucket 90 may be provided with the stirrer 96 to stir ice so that the ice stored at the ice bucket 90 may be easily outlet through the outlet 95 at a lower end of the ice bucket 90, and a passive coupler 98 to deliver a rotational force at the stirrer 96 while connected to the stirrer 96.

The cooling space 60 may be provided with a stirring motor 99 to generate a rotational force to rotate the stirrer 96, and a driving coupler 97 rotated by receiving a driving force from the stirring motor 99 and coupled to the passive coupler 98. The stirring motor 99 and the driving coupler 97 may be connected by a decelerating connection unit (not shown).

The driving coupler 97 and the passive coupler 98 may receive a driving force by reciprocally coupled to each other when the door 30 is closed, and when the door 30 is open, the driving coupler 97 and the passive coupler 98 may be reciprocally separated from each other. As set forth above, as the stirring motor 99 is provided at the cooling space 60 of the body 10, the structure of the ice bucket 90 is simplified, and an ice storage space of an inside the ice bucket 90 may be expanded.

The ice bucket 90 may be provided with the cool air inlet 91, as well as a sealing member 94 closely attached to the cover plate 50 to seal the cool air outlet 92. The sealing member 94 may be formed of a rubber material. The sealing member 94 may be formed to wrap around the all of the cool air inlet 91, the cool air outlet 92, and the ice inlet unit 93. The sealing member 94 may be closely attached to the front inclination unit 61 of the cover plate 50.

However, in contrast to the above example, the sealing member may be provided at the cover plate 50.

The cooling space 60 may be provided with a water supplying system 100 to supply water to the ice maker 90 or to supply water to the dispenser 34 of the door 30. That is, a side of one side wall of the cooling space 60 may be provided with the evaporator 70, the blower fan 61, and the ice maker 80, and a side of an opposite side wall of the cooling space 60 may be provided with the water supplying system 100.

The water supplying system 100 may include a filter 101 to filter the water supplied from an outside water supplying source, a water tank 102 to cool water by use of the cool air of the cooling space 60, a valve 103 to divide the water supplied from the outside water supplying source into the water tank 102 and the ice maker 80, and a water supplying hose 104 to connect the filter 101, the water tank 102, the valve 103, and the ice maker 80.

The filter 101 may be detachably coupled to a connector 105 into which the water supplying hose 104 is coupled. The cover plate 50 may be provided with a filter mounting hole 54 capable of mounting and dismounting the filter 101 at the connector 105, and a filter cover 55 may be coupled to the filter mounting hole 54 to open or close the filter mounting hole 54. The filter cover 55 may be rotatably provided while having the hinge axis 56 as a center.

The valve 103 is connected to an end portion of an exit of the filter 101, and may divide the water filtered at the filter 101 into the water tank 102 and the ice maker 80. Therefore, the valve 103 may be provided in the form of a 3-way flow path converting valve.

The water tank 102 is disposed at the cooling space 60, and thus may be cooled by the cool air circulated at the cooling space 60 without a separate duct structure. The water cooled at the water tank 102 may be supplied to the dispenser 34 of the door 30 through the water supplying hose 104. The water supplying hose 104 connecting the water tank 102 to the dispenser 34 may be connected to the dispenser 34 of the door 30 through a hinge unit of the door 30.

With the structure above, the evaporator 70 to generate cool air, the ice maker 80 to generate ice, and the water supplying system 100 to supply water are all provided at the cooling space 60 provided at the ceiling of the refrigerator, and thus the rear wall 16 of the body 10 of the refrigerator may be evenly leveled, and the usefulness of space may be increased.

An operation of the refrigerator in accordance with the embodiment of the present disclosure will be briefly described. When the blower fan 61 disposed at the cooling space 60 is driven, the air of the storage compartment 21 is inlet into the cooling space 60 through the cool air collecting hole 53 of the cover plate 50. In addition, the air of the ice bucket 90 is inlet into the cooling space 60 through the cool air collecting duct 57.

The inlet air is cooled through the evaporator 70, and the cooled air is discharged toward a front of the evaporator 70. A portion of the cooled air is provided to cool the ice maker 80 and the water supplying system 100 while circulating at an inside of the cooling space 60, the other portion of the cooled air is provided to cool an inside of the storage compartment 21 while being supplied to the storage compartment 21 through the cool air supplying hole 52 of the cover plate 50, and the remaining portion of the cooled air is provided to cool an inside of the ice bucket 90 while being supplied to the ice bucket 90 through the ice bucket cool air supplying hole 62 of the cover plate 50.

From the above, the embodiment having the cooling space 60 formed at the ceiling of the body 10 of the refrigerator and provided with the all of the evaporator 70, the ice maker 80, and the water supplying system 100 included at the cooling space 60 is described, but the present embodiment is provided as one example for the convenience of description, and the aspect of the present disclosure is not limited to the present embodiment.

As is apparent from the above, in accordance with an aspect of the present disclosure, as an evaporator is disposed at a ceiling of a refrigerator, a rear wall of a storage compartment of the refrigerator may be evenly leveled and usefulness of space may be increased.

In accordance with another aspect of the present disclosure, as an evaporator and a water supplying system are simultaneously disposed at a cooling space provided at a ceiling of a refrigerator, no separate space is needed to be provided for the water supplying system, and the cool air generated at the evaporator may directly cool the water supplying system.

In accordance with still another aspect of the present disclosure, an evaporator is provided at a ceiling of a refrigerator, and the cool air generated at the evaporator may cool a storage compartment and an ice bucket of a door together.

Although a few embodiments of the present disclosure have been shown and described, it would be appreciated by those skilled in the art that changes may be made in these embodiments without departing from the principles and spirit of the disclosure, the scope of which is defined in the claims and their equivalents.

As one example, even when any particular one of the ice maker 80, the water supplying system 100, and the ice bucket 90 is not included, any embodiment provided with a structure of the cooling space 60 compartmented and formed by the cover plate 50 at the ceiling of the body 10 of the refrigerator, the evaporator 70 provided at the cooling space 60, and the cool air generated at the evaporator 70 circulated at the cooling space 60 and the storage compartment 21 through the cool air supplying hole 52 and the cool air collecting hole 53 of the cover plate 50 may be included in the aspect of the present disclosure.

What is claimed is:

1. A refrigerator, comprising:
a body having a storage compartment;
a door configured to open and to close the storage compartment;
a cover plate disposed at an inside of the storage compartment;
a cooling space formed in the body between the cover plate and a ceiling of the body;
a motor in the cooling space;
an evaporator disposed at an inside of the cooling space and configured to generate cool air;
a blower fan disposed at the inside of the cooling space and configured to forcedly circulate the cool air generated by the evaporator;
an ice maker disposed at the inside of the cooling space and configured to generate ice;
an ice bucket disposed at the door and configured to store the ice generated by the ice maker at the inside of the cooling space, the ice bucket including a stirrer couplable to the motor in the cooling space and configured to stir the ice stored in the ice bucket;
a cool air supplying hole formed in the cover plate and configured to supply the cool air of the cooling space to the storage compartment; and
a cool air collecting hole formed at the cover plate and configured to collect the cool air heated at the storage compartment to the cooling space.

2. The refrigerator of claim 1, wherein:
the cool air supplying hole is provided at a front of the evaporator.

3. The refrigerator of claim 1, wherein:
the cool air collecting hole is provided at a rear of the evaporator.

4. The refrigerator of claim 1, wherein:
the ice maker is provided at a front of the evaporator.

5. The refrigerator of claim 1, further comprising:
an ice bucket cooling air supplying hole formed at the cover plate to supply the cool air of the cooling space to the ice bucket.

6. The refrigerator of claim 5, wherein:
the ice bucket cooling air supplying hole is provided at the front of the evaporator.

7. The refrigerator of claim 1, further comprising:
a cool air collecting duct configured to communicate the cooling space with the ice bucket to collect the cool air heated at the ice bucket to the cooling space.

8. The refrigerator of claim 7, wherein:
an entry of the cool air collecting duct is provided at the front of the evaporator, and an exit of the cool air collecting duct is provided at a rear of the evaporator.

9. The refrigerator of claim 1, further comprising:
a defrosting heater provided near the evaporator in the cooling space and configured to remove frost generated at the evaporator.

10. The refrigerator of claim 1, further comprising:
a drain plate provided below the evaporator in the cooling space and configured to collect defrost water generated at the evaporator.

11. The refrigerator of claim 10, wherein:
the drain plate is downwardly inclined toward a rear wall of the body and configured to guide the collected defrost water toward the rear wall of the body.

12. The refrigerator of claim 1, wherein:
a refrigerant inlet pipe of the evaporator and a refrigerant outlet pipe of the evaporator each are positioned at a front of the evaporator.

13. The refrigerator of claim 4, further comprising:
a water supplying system provided at the cooling space to supply water to the ice maker or to supply water to a dispenser of the door.

14. The refrigerator of claim 13, wherein:
the water supplying system comprises a filter configured to filter the water supplied from an outside water supplying source.

15. The refrigerator of claim 13, wherein:
the water supplying system comprises a water tank configured to cool water by cool air of the cooling space.

16. The refrigerator of claim 15, wherein:
the water supplying system comprises a valve configured to divide the water supplied from the outside water supplying source to the water tank and the ice maker.

17. A refrigerator, comprising:
a body having a storage compartment;
a door configured to open and to close the storage compartment;
a cover plate disposed at an inside of the storage compartment;
a cooling space formed in the body between the cover plate and a ceiling of the body;
an evaporator disposed at an inside of the cooling space and configured to generate cool air;
a blower fan disposed at the inside of the cooling space and configured to forcedly circulate the cool air generated by the evaporator;
an ice maker disposed at the inside of the cooling space at a front of the evaporator and configured to generate ice;
an ice bucket disposed at the door and configured to store the ice generated by the ice maker at the inside of the cooling space;

a cool air supplying hole formed in the cover plate and configured to supply the cool air of the cooling space to the storage compartment;

a cool air collecting hole formed at the cover plate and configured to collect the cool air heated at the storage compartment to the cooling space; and a water supplying system provided at the cooling space and configured to supply water to the ice maker or to supply water to a dispenser of the door and including a filter configured to filter the water supplied from an outside water supplying source, wherein the filter is mountably and detachably provided through the cover plate.

18. The refrigerator of claim 17, wherein:

the cover plate comprises a filter mounting hole to mount and dismount the filter therethrough, and a filter cover configured to open or to close the filter mounting hole.

19. A refrigerator, comprising:

a body having a storage compartment;

a door configured to open and to close the storage compartment;

a cover plate disposed at an inside of the storage compartment;

a cooling space formed in between the cover plate and a ceiling of the body;

a motor in the cooling space;

an evaporator disposed at an inside of the cooling space and configured to generate cool air;

a blower fan disposed at the inside of the cooling space and configured to forcedly circulate the cool air generated at the evaporator;

an ice maker disposed at the inside of the cooling space and configured to generate ice;

an ice bucket disposed at the door to store the ice generated by the ice maker at the inside of the cooling space, the ice bucket including a stirrer couplable to the motor in the cooling space and configured to stir the ice stored in the ice bucket; and a water supplying system disposed at the inside of the cooling space and configured to supply water to the ice maker or to supply water to a dispenser of the door.

20. The refrigerator of claim 19, wherein:

a portion of the cool air of the cooling space cools the water supplying system of the cooling space while circulating inside the cooling space, and the remaining portion of the cool air of the cooling space is collected to the cooling space after cooling the storage compartment while supplied to the storage compartment.

21. The refrigerator of claim 20, wherein:

a portion of the cool air of the cooling space cools the water supplying system of the cooling space while circulating inside the cooling space, another portion of the cool air of the cooling space is collected to the cooling space after cooling the storage compartment while supplied to the storage compartment, and the remaining portion of the cool air of the cooling space is collected to the cooling space after cooling the ice bucket while supplied to the ice bucket.

22. A refrigerator, comprising:

a body having a storage compartment;

a door configured to open and to close the storage compartment;

a cover plate disposed at an inside of the storage compartment;

a cooling space formed in between the cover plate and a ceiling of the body;

a motor in the cooling space;

an evaporator disposed at an inside of the cooling space and configured to generate cool air;

a blower fan disposed at the inside of the cooling space and configured to forcedly circulate the cool air generated at the evaporator;

an ice maker disposed at the inside of the cooling space and configured to generate ice; and an ice-bucket disposed at the door and configured to store the ice generated by the ice maker at the inside of the cooling space, the ice bucket including a stirrer couplable to the motor in the cooling space and configured to stir the ice stored in the ice bucket.

23. The refrigerator of claim 22, wherein:

a portion of the cool air of the cooling space is collected to the cooling space after cooling the storage compartment while supplied to the storage compartment, and the remaining portion of the cool air of the cooling space is collected to the cooling space after cooling the ice bucket while supplied to the ice bucket.

24. The refrigerator of claim 22, further comprising:

a water supplying system provided at the cooling space to supply water to the ice maker or to supply water to a dispenser of the door.

25. The refrigerator of claim 24, wherein:

a portion of the cool air of the cooling space cools the water supplying system of the cooling space while circulating inside the cooling space, another portion of the cool air of the cooling space is collected to the cooling space after cooling the storage compartment while supplied to the storage compartment, and the remaining portion of the cool air of the cooling space is collected to the cooling space after cooling the ice bucket while supplied to the ice bucket.

* * * * *